US007658009B2

(12) United States Patent
Bunnell et al.

(10) Patent No.: US 7,658,009 B2
(45) Date of Patent: Feb. 9, 2010

(54) SHAVING IMPLEMENT

(75) Inventors: Jay Bunnell, Orange, CT (US); Mark S. Peyser, Easton, CT (US); Joseph Fedora, Meriden, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 213 days.

(21) Appl. No.: 11/485,038

(22) Filed: Jul. 11, 2006

(65) Prior Publication Data

US 2007/0006464 A1 Jan. 11, 2007

Related U.S. Application Data

(60) Provisional application No. 60/698,532, filed on Jul. 11, 2005.

(51) Int. Cl.
*B26B 21/44* (2006.01)

(52) U.S. Cl. ..... 30/41; 30/50; 30/527

(58) Field of Classification Search ..... 30/41, 30/50, 526, 527, 531, 532
See application file for complete search history.

(56) References Cited

U.S. PATENT DOCUMENTS 4,970,784 A * 11/1990 Althaus et al. ..... 30/527
5,903,979 A * 5/1999 Oldroyd ..... 30/41
6,886,254 B1 5/2005 Pennella
7,103,976 B2 * 9/2006 Pennella ..... 30/32
7,266,895 B2 * 9/2007 Pennella et al. ..... 30/531
2003/0200659 A1 * 10/2003 Coffin et al. ..... 30/47
2003/0200660 A1 10/2003 Pennella

OTHER PUBLICATIONS

International Search Report dated Nov. 7, 2006, for PCT/US2006/026958.

* cited by examiner

*Primary Examiner*—Hwei-Siu C Payer

(57) ABSTRACT

The present invention resides in a shaving implement having a handle; a razor cartridge; a self-leveling mechanism operably coupled to the razor cartridge and the shaving aid body; and a pivoting mechanism operably coupled to the shaving aid body and the handle to permit pivotal movement of the razor cartridge and the shaving aid body together relative to the handle. The shaving aid body has a top surface, and at least a portion of the shaving aid body is adjacent the razor cartridge. The self-leveling mechanism permits the top surface of the shaving aid body to remain coplanar with a shave plane while shaving.

20 Claims, 7 Drawing Sheets

SHAVING IMPLEMENT

CROSS REFERENCE TO RELATED APPLICATIONS

This application claims the benefit of Provisional Patent Application Ser. No. 60/698,532, filed Jul. 11, 2005.

TECHNICAL FIELD

The present invention is related to shaving implements in general and, more particularly, to shaving implements having improved abilities to maintain contact with surfaces being shaved.

BACKGROUND OF THE INVENTION

Shaving implements typically include a razor cartridge mounted to a handle. The cartridge includes one or more razor blades that are located aft of a leading surface and forward of a trailing surface. A guard is mounted to or integral with the leading surface to stretch the skin as the shaving implement is moved over the skin, which causes the hairs to stand substantially erect in preparation for cutting. A cap is also mounted to or integral with the trailing surface. The skin-engaging surfaces of the guard and the cap and cutting edges of the razor blades are generally substantially aligned to define a shave plane. The razor cartridge may be movably mounted to the handle to allow the razor blades an increased range of movement during a shaving operation. Shaving aid material is often applied in anticipation of a shaving operation to soften the hairs, condition the skin, provide lubrication, etc.

In some shaving implements, a shaving aid body comprising a soap-type shaving aid material may be positioned to entirely surround the razor cartridge and the razor blades, thereby enabling a user to apply shaving aid material during the shaving process. However, because soap-type shaving aid materials erode during use, most of these types of shaving implements include a self-leveling mechanism that keeps the top surface of the shaving aid body and the shave plane of the razor cartridge substantially coplanar during use in order to provide the device with a suitable service life.

In shaving implements that utilize self-leveling mechanism, the shaving aid body and the razor cartridge move relative to each other in order for the shaving aid body and the razor cartridge to remain coplanar during the shaving operation. By remaining coplanar, both the shaving aid body and the razor blades contact the skin simultaneously during normal shaving. In some embodiments, pivotal motion of the razor cartridge relative to the shaving aid body is also permitted.

In any of the above-described shaving implements, the nature of limited pivotal movement or non-pivotal movement of the razor cartridge may cause the razor blades to occasionally lose contact with the surface being shaved, particularly as the user moves the implement over a relatively sharply-defined contour in the surface (e.g., over the edge defined by a shin bone or over a fold of skin in the axillary region). In these instances a less-than-optimum shave may be produced, which may result in the user having to shave one area several times. By causing the razor blades to engage and re-engage the same surface multiple times, the skin, particularly in sensitive areas, may become irritated and cause discomfort to the person being shaved.

Based on the foregoing, what is needed is a shaving implement that is capable of maintaining the razor blades and the shaving aid body in contact with the surface being shaved over difficult-to-shave contours.

SUMMARY OF THE INVENTION

In one aspect, the present invention resides in a shaving implement having a handle; a razor cartridge; a self-leveling mechanism operably coupled to the razor cartridge and the shaving aid body; and a pivoting mechanism operably coupled to the shaving aid body and the handle to permit pivotal movement of the razor cartridge and the shaving aid body together relative to the handle. The shaving aid body has a top surface, and at least a portion of the shaving aid body is adjacent the razor cartridge. The self-leveling mechanism permits the top surface of the shaving aid body to remain coplanar with a shave plane while shaving.

In a second aspect, the present invention resides in a head for a shaving implement. The head has an insert; a shaving aid body mounted thereon; and a razor cartridge received through an aperture in the insert. The insert includes a base in which the aperture is substantially centrally located, a connecting member attached to the base, and a biasing member attached to the base. The razor cartridge has at least one razor blade mounted therein. The pivotal connecting member pivotally connects the insert to a fixed point about which the insert, the shaving aid body, and the razor cartridge are pivotal in unison between a neutral position and a rotated position. The biasing member urges the insert toward the neutral position when the insert is pivotally connected to the handle.

In a third aspect, the present invention resides in a razor having a handle and a razor head pivotally attached to the handle so as to be movable between a neutral position and a rotated position. The razor head has a shaving aid body having a skin-contacting surface and a razor cartridge adjacent the shaving aid body, the razor cartridge defining a shave plane. The skin-contacting surface of the shaving aid body is maintained in a coplanar relationship with the shave plane.

The flexibility of the shaving implement of the present invention makes the razor blades more likely to remain in contact with the surface being shaved, as compared to shaving implements in which one or both of the razor cartridge and shaving aid body do not pivot relative to the handle. The pivotal attachment of the razor cartridge and shaving aid body to the handle, coupled with the self-leveling feature, allows the razor blades to remain on the skin over various surface contours.

DETAILED DESCRIPTION OF THE PREFERRED EMBODIMENTS

Figure 1:
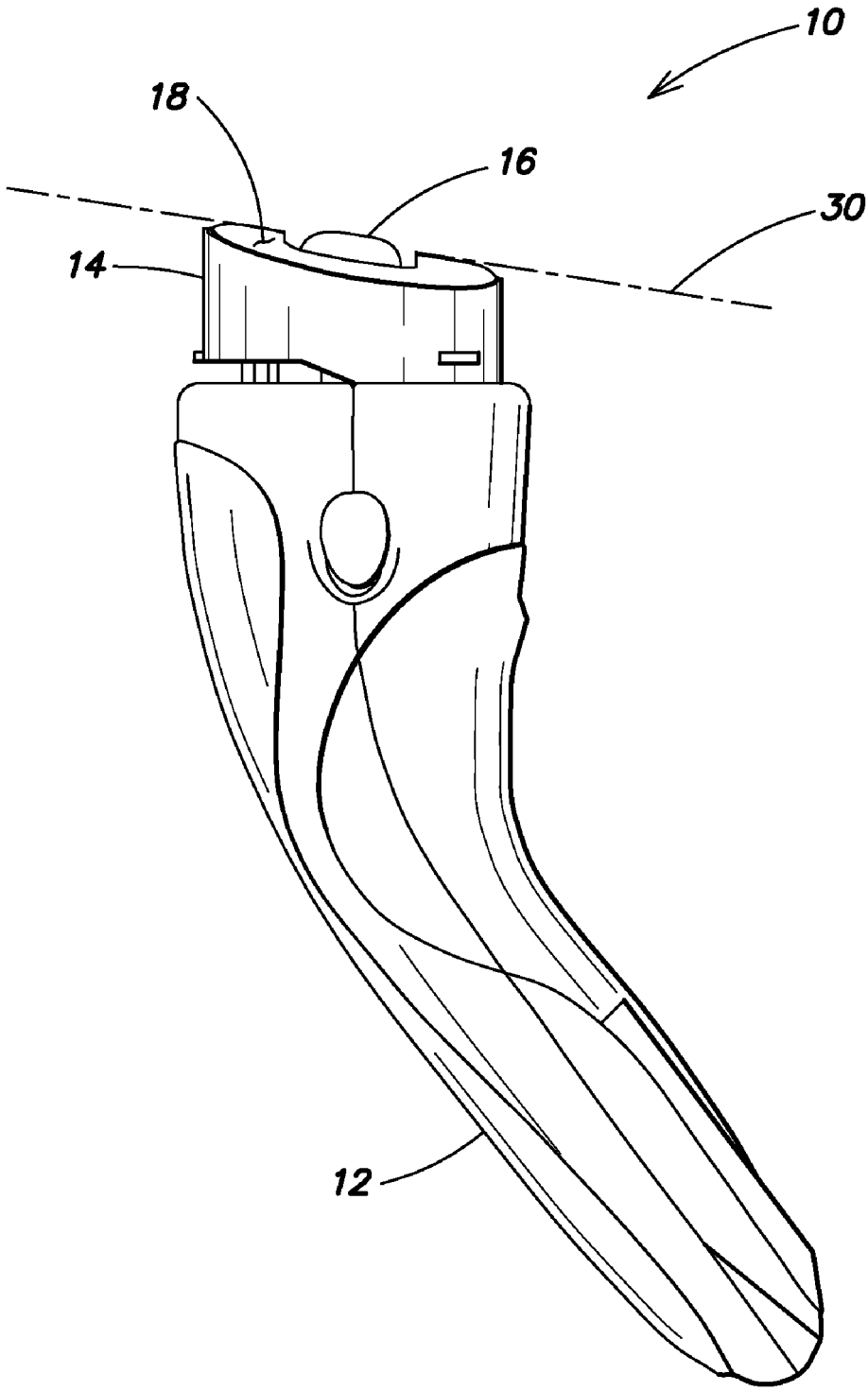
FIG. 1 is a side view of one embodiment of a shaving implement of the present invention, wherein the shaving aid body and razor cartridge are in the neutral position.
Figure 2:
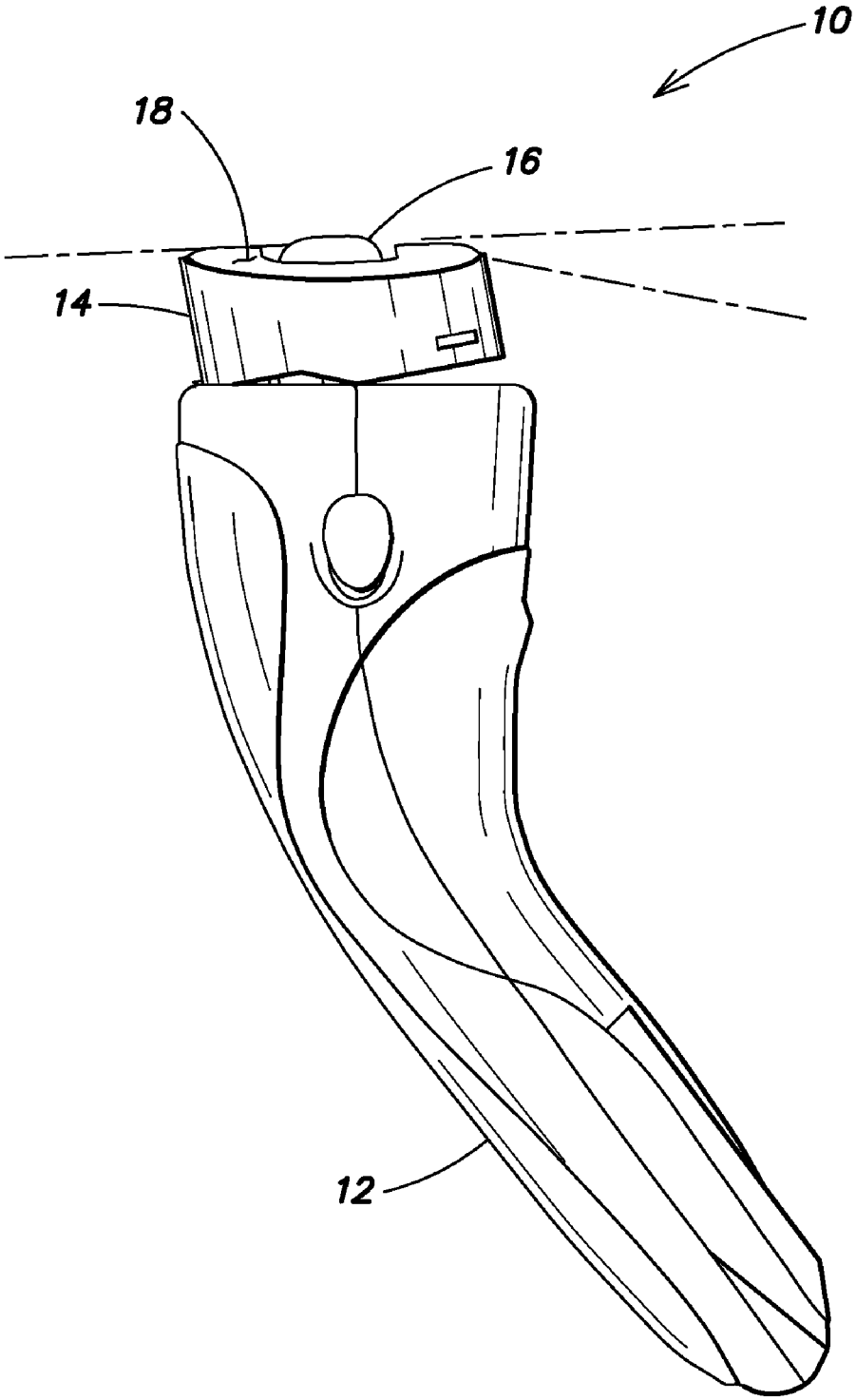
FIG. 2 is a side view of the shaving implement of FIG. 1, wherein the shaving aid body and razor cartridge are in a rotated position.

Referring to FIGS. 1 and 2, one exemplary embodiment of the shaving implement of the present invention is shown generally at 10. The shaving implement 10 includes a handle 12, a shaving aid body 14 operably attached to the handle, and a razor cartridge 16 operably connected to the handle and extending through the shaving aid body to a top surface 18 of the shaving aid body. The shaving aid body 14 and the razor cartridge 16 are mounted on the handle 12 such that both are pivotal as a unit relative to the handle. In particular, the shaving aid body 14 and the razor cartridge are pivotal from a neutral position (FIG. 1) to a rotated position (FIG. 2). The shaving implement 10 also includes a self-leveling mechanism that enables the razor cartridge 16 to move relative to the top surface 18 of the shaving aid body 14.

The handle 12 is of any suitable shape and size that allows it to be gripped and manipulated by the user. One exemplary type of handle is shown and described in U.S. Design Pat. No. 500,169 to Dombrowski et al., which is hereby incorporated by reference in its entirety. However, the present invention is not limited in this regard, and other handles are within the scope of the present invention. In any embodiment, the handle 12 is preferably ergonomically or similarly contoured.

Figure 3:
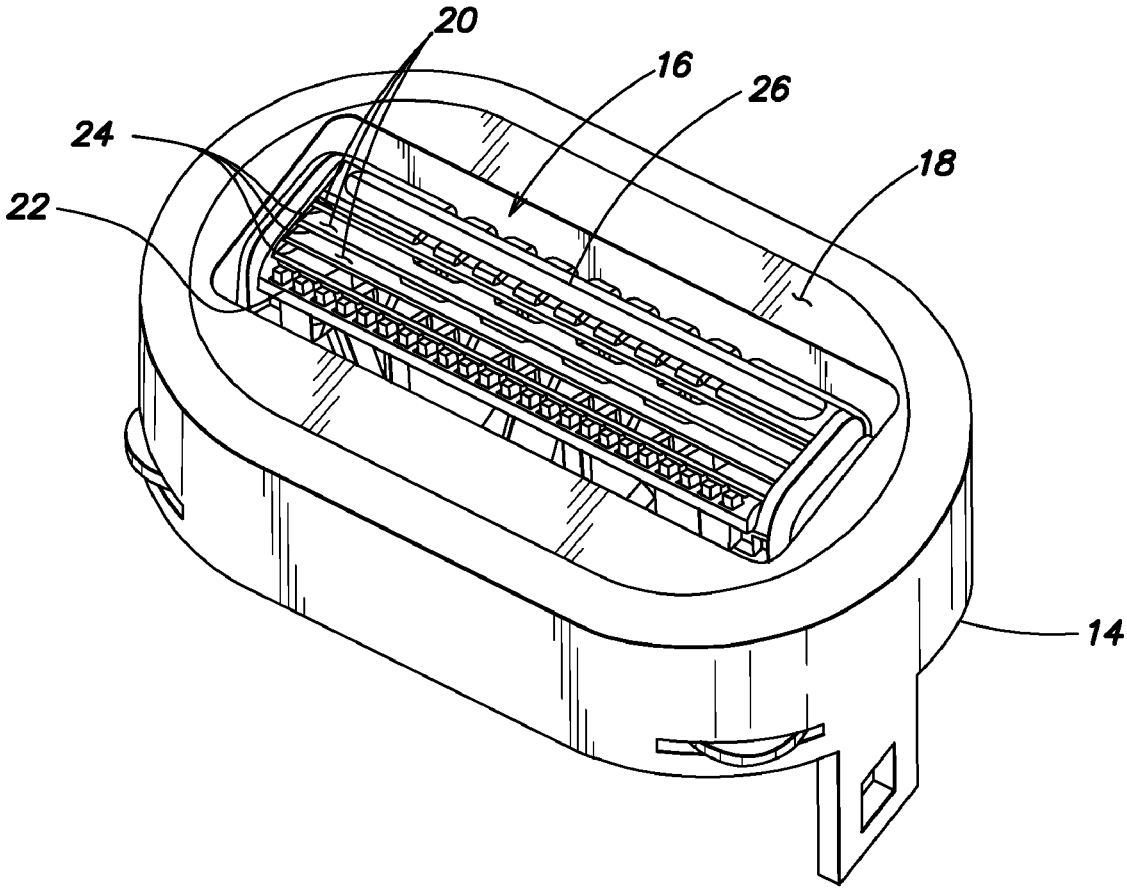
FIG. 3 is a perspective view of a shaving aid body surrounding a razor cartridge.

Referring now to FIG. 3, the razor cartridge 16 and the shaving aid body 14 are mounted to an insert 28, which is pivotally attachable to the handle. The razor cartridge 16, which is operably connected to the insert 28 through the self-leveling mechanism, includes at least one razor blade 20 mounted therein, each razor blade having a cutting edge 24. The razor cartridge 16 also includes a guard 22 positioned forward of the razor blades 20 and a cap 26 positioned aft of the razor blades. The razor blades 20 are mounted in the razor cartridge 16 such that the cutting edges 24 thereof are substantially coplanar with the top surface 18 of the shaving aid body 14, which thereby defines a shave plane 30 (shown in FIGS. 1 and 2). For the purposes of the present invention, the term "shave plane" is intended to indicate a theoretical plane that extends tangentially from the uppermost surface of the guard 22 to the uppermost surface of the cap 26 aft of the razor blade.

One exemplary type of shaving aid body for use with the insert 28 is disclosed in U.S. patent application Ser. No. 10/367,133 to Coffin et al., which is hereby incorporated by reference in its entirety. The shaving aid body 14 can be of any suitable type, such as an erodable solid body of shaving aid material that is selected to suit the application at hand. A soap-type shaving aid material is particularly well-suited for wet shaving applications in which the shaving implement 10 may be used. Other shaving aid materials (e.g., lubricating agents, drag-reducing agents, depilatory agents, cleaning agents, medicinal agents, sensory agents, skin stimulators, etc.) can be used in combination with soap-type shaving aid materials. The present invention is not limited to erodable soap-type shaving aid materials, however, and other types of material such as non-erodable foams or similar porous material from which soaps or other shaving aid materials may be exuded are within the scope of the present invention.

The shaving aid body 14 is coupled to the insert 28 such that at least a portion of the shaving aid material is adjacent the razor cartridge 16. In embodiments in which the shaving aid body 14 comprises an erodable material, the top surface 18 continually changes during normal use. In order to maintain a generally coplanar relationship between the top surface 18 of the shaving aid body 14 and the shave plane 30, a self-leveling mechanism is attached to the insert 28 to allow the razor cartridge 16 to move relative to the shaving aid body 14.

Figure 4:
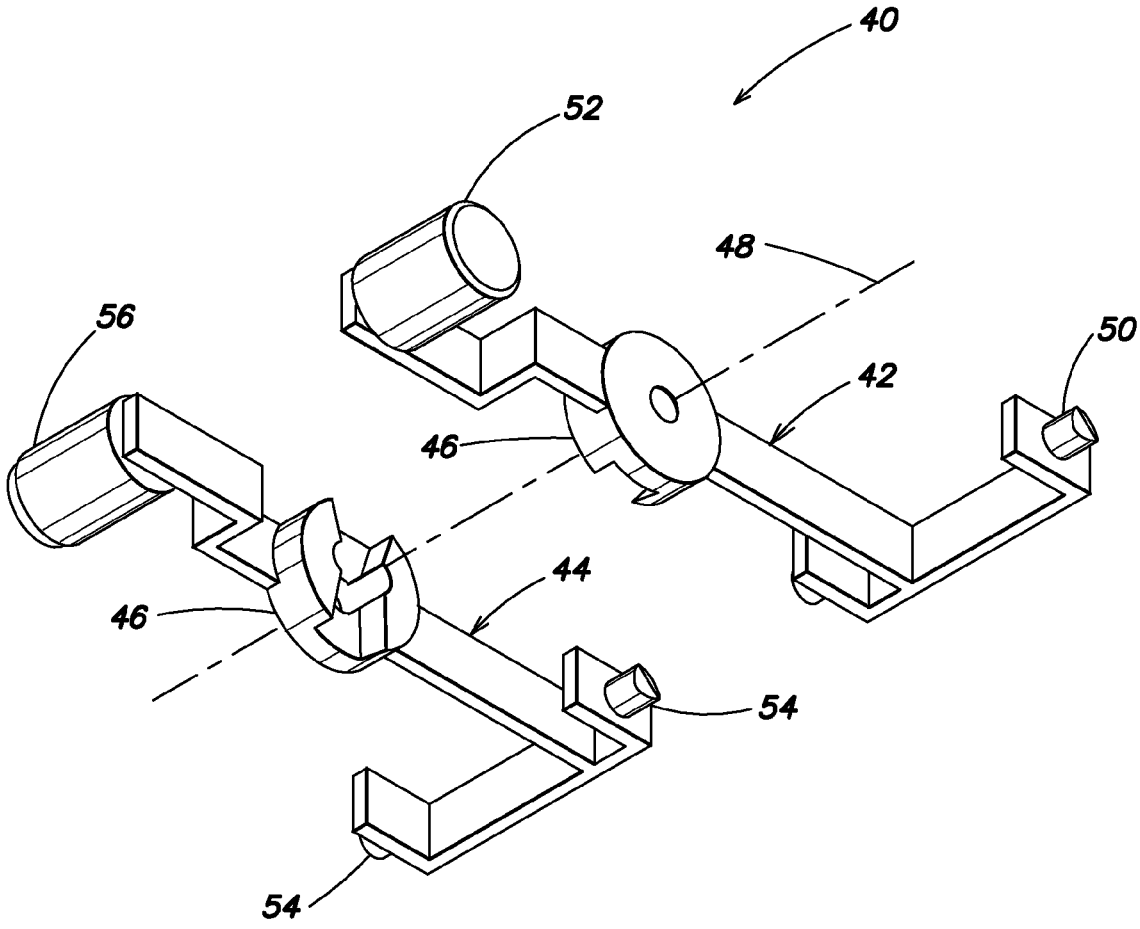
FIG. 4 is an exploded perspective view of a self-leveling mechanism of the present invention.

Referring now to FIG. 4, one exemplary type of self-leveling mechanism is shown at 40. Self-leveling mechanism 40 is a cooperating linkage arrangement that operates using a scissoring action. Two cooperating linkages are assembled and disposed in the handle and permit the razor cartridge to move relative to the top surface of the shaving aid body such that the shave plane and the top surface remain co-planar during normal shaving. The cooperating linkages include a first linkage member 42 pivotally mounted to a second linkage member 44 at a pivot mounting point 46 through which an axis 48 extends. One end of the first linkage member 42 is pivotally connected to the insert via at least one first insert connecting pin 50, and the other end of the first linkage member is pivotally connected to the razor cartridge via a first cartridge connecting pin 52. Also, one end of the second linkage member 44 is pivotally connected to the insert via at least one second insert connecting pin 54, and the other end of the second linkage member is pivotally connected to the razor cartridge via a second cartridge connecting pin 56. Scissoring action about the pivot mounting point 46 enables the razor cartridge and the shaving aid body to move relative to each other and to move relative to the handle. More specifically, because the razor cartridge and the shaving aid body are attached to the first linkage member 42 and the second linkage member 44 on opposite sides of the pivot mounting point 46, the razor cartridge and the insert/shaving aid body are able to "see-saw" about the pivot mounting point. The present invention is not limited in regard to the type of cooperating linkage disclosed herein, however, as other types of mechanisms may be utilized to produce the same or similar effects. At least one other type of cooperative mechanism that permits the shave plane of the razor cartridge to coincide with the top surface of the shaving aid body is disclosed in U.S. patent Ser. No. 10/367,255 to Pennella et al., which is hereby incorporated by reference in its entirety.

In another exemplary embodiment, the razor cartridge 16 can be mounted on a razor cartridge support that is slidingly coupled to the insert 28 to ensure that the razor cartridge and the shaving aid body remain adjacent one another during normal use. The addition of the razor cartridge support also enables the razor cartridge and the shaving aid body to be coupled together, and further enables them to be packaged and sold together as a replacement single unit for the shaving implement. In still another exemplary embodiment, the razor cartridge could, for example, include structures that enable the razor cartridge to be directly slidingly engaged to the insert 28, as well. Such an embodiment eliminates the need for a razor cartridge support.

Referring now to FIGS. 5-8, the insert 28 includes a base 58 and tabs 60 or the like that enable the shaving aid body and the razor cartridge to pivot relative to the handle. The base 58 includes an aperture 62 sized to receive the razor cartridge therethrough so that, during use, the razor cartridge can be completely surrounded by the shaving aid body. The base 58 can be any suitable shape (e.g., generally oval). Mounting pins 59 extend from the base 58 to facilitate the location of the base in the handle. Anchoring tabs 61 are integrally formed with the base 58 to provide anchoring surfaces for the shaving aid material. The entire insert 28 can be made of any suitable material known to those of skill in the art; however, plastics such as polypropylene and ABS have proven to have particular utility.

Figure 6:
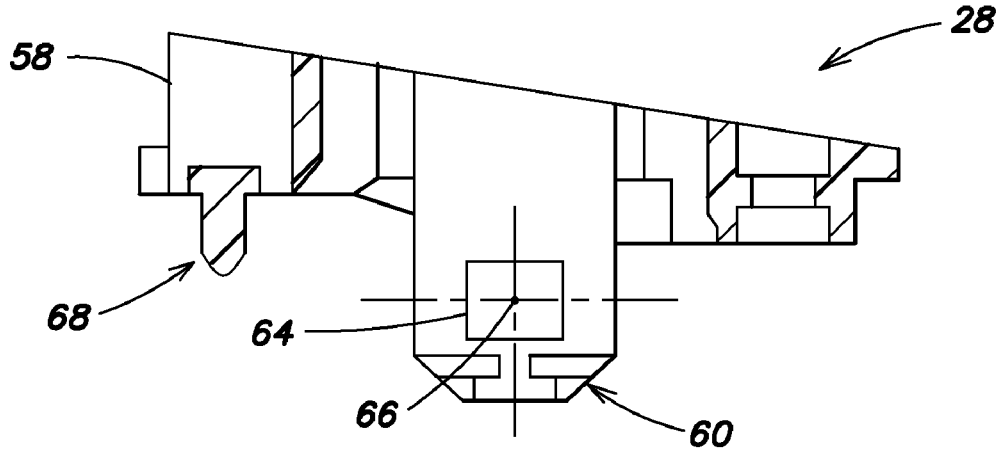
FIG. 6 is a side view of the insert of the present invention.
Figure 7:
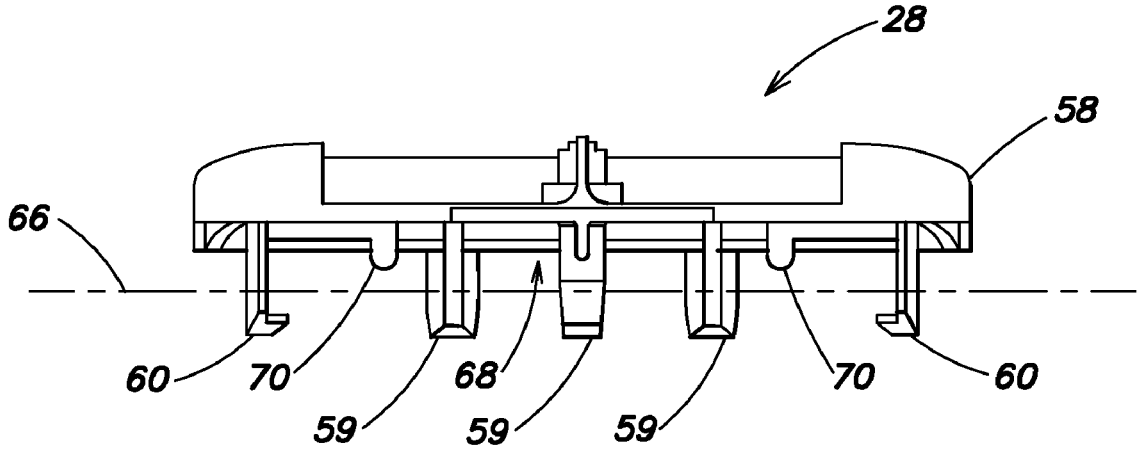
FIG. 7 is a front view of the insert of the present invention.
Figure 8:
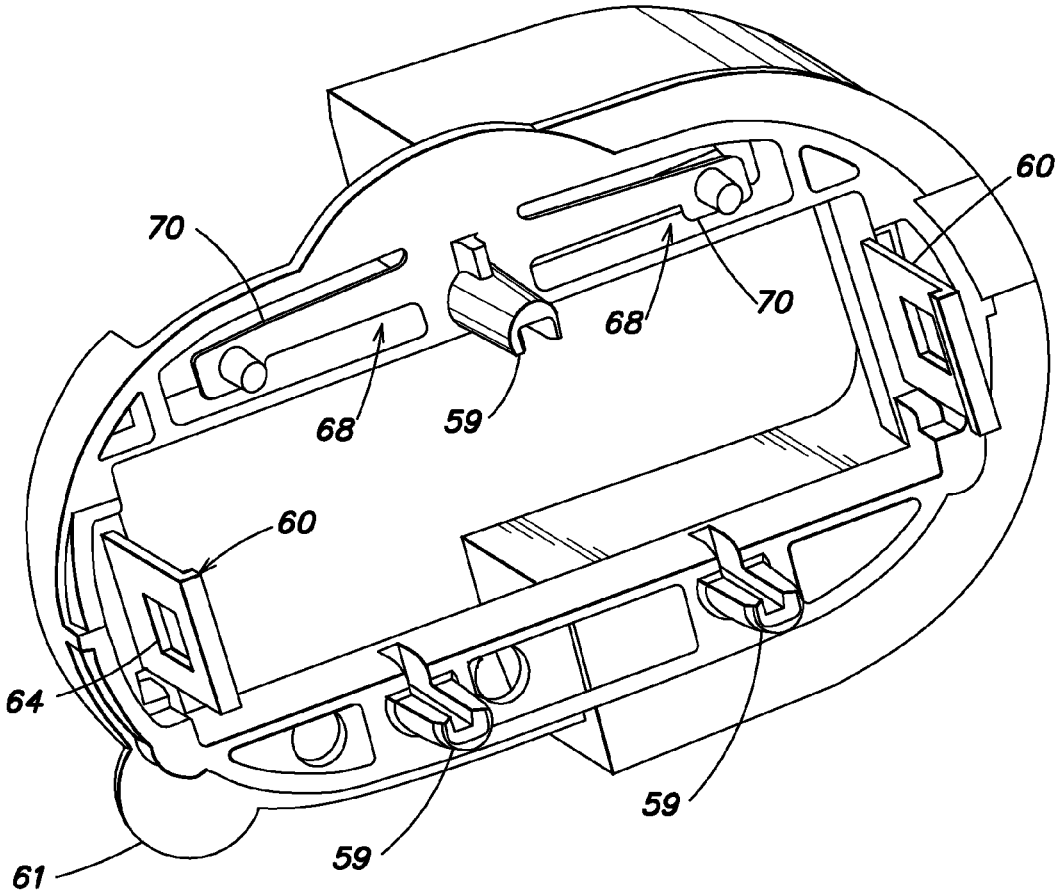
FIG. 8 is a perspective view of the insert of the present invention.

Referring specifically to FIGS. 6-8, the tabs 60 permit pivotal movement of the insert 28 (and the operably connected razor cartridge and the attached shaving aid body) relative to the handle between the neutral position (FIG. 1) and the rotated position (FIG. 2). In addition, the tabs 60 are operable to return the razor cartridge and the shaving aid body to the neutral position once forces exerted on the razor cartridge and shaving aid body are no longer present.

The tabs 60 include apertures 64 that receive complimentary protruding elements located on the handle. The apertures 64 and the tabs 60 are shaped and sized to allow for limited pivotal movement (namely, between the neutral and rotated position) of the insert 28 relative to the complimentary protruding elements located on the handle, and, accordingly, the handle. As shown, the apertures 64 are rectangular in shape to receive corresponding rectangular-shaped protruding elements located on the handle. The present invention is not limited in this regard, however, as other types of connections are within the scope of the present invention. For example, a round aperture that receives a cylindrically-shaped protruding element is also acceptable. Although the tab 60 is shown to have a female-type connector (e.g., the aperture 64) configured to mate with a male-type connector on the handle, the tab 60 could alternatively have a male-type protrusion that mates with a female-type receiver on the handle.

Figure 5:
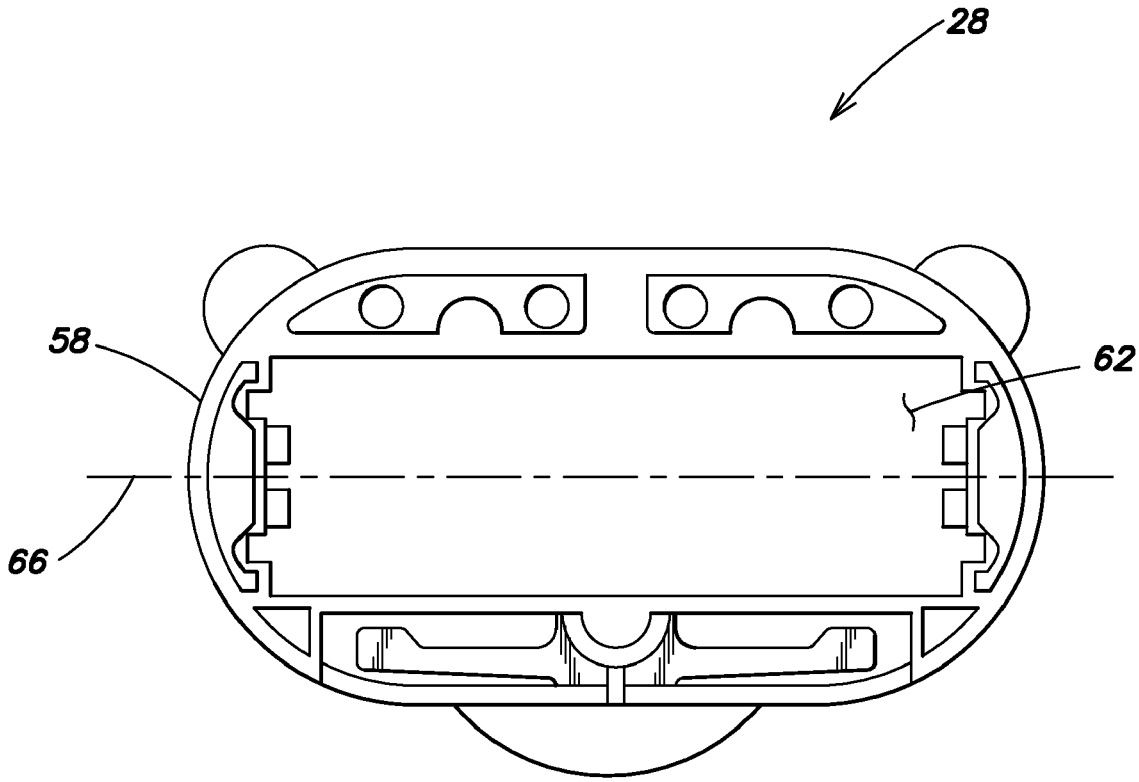
FIG. 5 is a top view of an insert of the shaving implement of the present invention.

In the embodiments shown, the insert 28 pivots about a pivot axis 66 that extends through the apertures 64, as indicated in FIGS. 5-7. In the embodiment shown, the apertures 64 and the pivot axis 66 are located below the shaving plane, and the pivot axis 66 extends generally beneath the razor cartridge. However, the pivot axis 66 and/or the tabs 60 can be located in any suitable location relative to the razor cartridge depending on the type of pivotal motion of the shaving aid body and razor cartridge desired.

Referring to FIGS. 6-8, a biasing member 68 can be operably located on the insert 28 to urge the insert back to the neutral position when deflected. The biasing member 68 can be a cantilevered spring 70. In a preferred embodiment, the biasing member 68 includes two cantilevered springs 70, both of which are deflected when the insert 28 (and, accordingly, the shaving aid body and the razor cartridge) are pivoted towards the rotated position. In turn, the cantilevered springs 70, when deflected, tend to urge the insert 28 towards the neutral position. In these embodiments, the biasing member 68 (and, more particularly, the cantilevered springs 70) can be located aft of the axis 66 about which the insert 28 pivots. Preferably, the biasing member 68 is aft of the apertures 64.

The fully-rotated position (shown in FIG. 2) is generally engaged when the shaving aid body and the razor cartridge are rotated about 10 degrees rearward of the neutral position. However, the rotated position should not be considered so limited. For example, the fully-rotated position can be greater than or less than 10 degrees rearward of the neutral position without departing from the scope of the present invention.

Referring back to FIGS. 1 and 2, during use, the razor cartridge 16 and shaving aid body 14 are brought into contact with the surface being shaved. As the razor cartridge 16 and shaving aid body 14 are moved along the surface, shaving aid is applied to the surface being shaved and unwanted hair is removed by the razor cartridge 16 simultaneously. As the shaving aid body 14 erodes, the self-leveling means maintains a substantially co-planar relationship between the top surface 18 of the shaving aid body 14 and the shave plane 30 of the razor cartridge 16. As often occurs during shaving, the shaving implement 10 can encounter outside forces, such as bumps or contours. When the razor cartridge 16 and/or shaving aid body 14 encounters such outside forces, the shaving aid body and the razor cartridge pivot together relative to the handle 12 between the neutral position and the rotated position. The pivoting action keeps the shaving aid body 14 and razor cartridge 16 in flush contact with the surface being shaved. Once the outside force is no longer being applied on the shaving implement 10, the biasing member urges the shaving aid body 14 and the razor cartridge 16 to return to the neutral position.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the appended claims.

What is claimed is:

1. A shaving implement, comprising:

a handle;

a razor cartridge defining a shave plane;

a shaving aid body coupled to the handle, wherein said shaving aid body has a top surface, and wherein at least a portion of the shaving aid body is adjacent the razor cartridge;

self-leveling means attached to said razor cartridge and said shaving aid body, said self-leveling means permitting said top surface of said shaving aid body to remain coplanar with said shave plane during a shaving operation; and pivoting means attached to said shaving aid body and said handle, said pivoting means permitting pivotal movement of said razor cartridge and said shaving aid body, together, relative to said handle wherein said pivoting means comprises, an insert, comprising, a base, and a tab extending from said base, said tab being pivotally connected to said handle such that said insert can pivot between a neutral position and a rotated position that is rearward of the neutral position.

2. The shaving implement of claim 1, further comprising a biasing member that is operable to urge said insert toward said neutral position.

3. The shaving implement of claim 2, wherein said biasing member is a cantilevered spring.

4. The shaving implement of claim 1, wherein said rotated position is about 10 degrees rearward of said neutral position.

5. The shaving implement of claim 1, wherein said shaving aid body is an erodable solid.

6. A shaving implement, comprising:

a handle; and a head, comprising an insert, comprising, a base having an aperture substantially centrally located therein, a connecting member attached to said base, and a biasing member attached to said base;

a shaving aid body mounted on said insert; and a razor cartridge received in said aperture, said razor cartridge having at least one razor blade mounted therein; and a self-leveling mechanism attached to said insert and said razor cartridge to maintain a top surface of said shaving aid body coplanar with a shave plane defined by said razor cartridge as said top surface changes during a shaving operation;

wherein said connecting member pivotally connects said insert to a fixed point about which said insert, said shaving aid body, and said razor cartridge are pivotal in unison between a neutral position and a rotated position; and wherein said biasing member is operable to urge said insert towards said neutral position when said insert is pivotally connected to said handle.

7. The shaving implement of claim 6, wherein said connecting member comprises a tab configured to receive a complementary engaging element on said fixed point, the engagement of said element and said tab defining an axis about which said insert is pivotal.

8. The shaving implement of claim 6, wherein said fixed point about which said insert is pivotal is on the handle.

9. The shaving implement of claim 6, wherein said biasing member comprises a cantilevered spring extending from said base.

10. The shaving implement of claim 6, wherein said base comprises one or more mounting pins extending therefrom for mounting said base.

11. The shaving implement of claim 6, wherein said shaving aid body is an erodable solid material.

12. The shaving implement of claim 6, wherein said shaving aid body is a non-erodable foam from which a shaving aid material is exuded.

13. A razor for shaving hair, said razor comprising:

a handle;

a razor head pivotally attached to said handle so as to be movable between a neutral position and a rotated position, said razor head comprising, a shaving aid body having a skin-contacting surface, and a razor cartridge adjacent said shaving aid body, said razor cartridge defining a shave plane, and a self-leveling mechanism operable to maintain said skin-contacting surface of said shaving aid body in a coplanar relationship with said shave plane as said skin-contacting surface changes during a shaving operation;

wherein said razor head comprises a base inserted into said handle, said shaving aid body and said razor cartridge being cooperably attached to said base; and wherein said base comprises a tab extending therefrom, said tab being cooperably attached to said handle to cause pivotal movement of said razor head.

14. The razor of claim 13, further comprising a biasing member operably engagable with said razor head to bias said razor head from said rotated position to said neutral position.

15. The razor of claim 14, wherein said biasing member comprises a cantilever spring.

16. The razor of claim 13, further comprising a biasing member attached to said base, said biasing member being configured to bias said razor head from said rotated position to said neutral position.

17. The razor of claim 16, wherein said biasing member comprises a cantilever spring.

18. The razor of claim 13, wherein said rotated position is about 10 degrees rotated from said neutral position.

19. The razor of claim 13, wherein said shaving aid body is an erodable soap material.

20. The razor of claim 19, wherein said self-leveling mechanism is a cooperating linkage arrangement operably connected to said shaving aid body and said razor cartridge such that a scissoring action of said cooperating linkage arrangement maintains said skin-contacting surface of said shaving aid body in said coplanar relationship with said shave plane.

* * * * *